US006516632B1

(12) United States Patent
Ulveling et al.

(10) Patent No.: US 6,516,632 B1
(45) Date of Patent: Feb. 11, 2003

(54) DEVICE FOR WET GRANULATION OF LIQUID-SLAG

(75) Inventors: Léon Ulveling, Howald (LU); Jean-Luc Roth, Thionville (FR); Henri Radoux, Bereldance (LU)

(73) Assignee: Paul Worth S.A. (LU)

( * ) Notice: Subject to any disclaimer, the term of this patent is extended or adjusted under 35 U.S.C. 154(b) by 0 days.

(21) Appl. No.: 09/720,138

(22) PCT Filed: Jun. 15, 1999

(86) PCT No.: PCT/EP99/04111

§ 371 (c)(1),
(2), (4) Date: Dec. 21, 2000

(87) PCT Pub. No.: WO00/00649

PCT Pub. Date: Jan. 6, 2000

(30) Foreign Application Priority Data

Jun. 26, 1998 (LU) ..... 90255

(51) Int. Cl.[7] ..... C04B 5/02
(52) U.S. Cl. ..... 65/19; 65/141
(58) Field of Search ..... 65/19, 141; 425/6, 425/7, 8, 9, 10

(56) References Cited

U.S. PATENT DOCUMENTS

| | | | |
|---|---|---|---|
| 1,416,069 | A | 5/1922 | Schumacher |
| 2,210,999 | A | 8/1940 | Bartholomew |

FOREIGN PATENT DOCUMENTS

| | | |
|---|---|---|
| DE | 1458808 | 2/1969 |
| DE | 2157653 | 5/1973 |

*Primary Examiner*—Sean Vincent
(74) *Attorney, Agent, or Firm*—Gary M. Nath; Harold L. Novick; Marvin C. Berkowitz

(57) ABSTRACT

A simple and compact device for wet granulation of liquid slag, comprising a granulating basin with a water injection device and a decanting basin that is separate from the granulating basin. A distribution channel for the granulate-water mixture extends above the decanting basin and is provided with outflow means along the entire length and on the lower side thereof for the granulate-water mixture. A vertical inflow shaft that is open towards the bottom is arranged underneath the distribution channel. The outflow means for the granulate-water mixture discharges into said inflow shaft.

11 Claims, 2 Drawing Sheets

DEVICE FOR WET GRANULATION OF LIQUID-SLAG

TECHNICAL FIELD

The invention relates to a device for wet granulation of liquid slag.

BACKGROUND OF THE INVENTION

In wet granulation a liquid slag flow is introduced into a powerful water flow, the liquid slag entrained by the water flow being granulated, solidified and cooled. The granulate is subsequently dewatered.

Devices for wet granulation of liquid slag are known, for example, from the blast furnace sector. They comprise a granulating basin with an injection device for the granulating water as well as equipment for dewatering the granulate. Conventional dewatering equipment comprises a decanting basin separate from the granulating basin, in which the slag granulate settles.

In wet granulation there is a non-negligible explosion hazard due to both the release of hydrogen and the explosive overheating of water vapour. In order to reduce this explosion hazard it is necessary to operate with very large water flows. These large water flows necessitate, of course, large space-consuming decanting basins.

To avoid such space-consuming decanting basins, it is known to use dewatering drums as described, for example, in U.S. Pat. No. 4,204,855. In large blast furnace plants such dewatering drums quickly pay off due to their high dewatering capacity. For smaller slag quantities, as for example produced in electric steel plants, wet granulation with a dewatering drum downstream is however too expensive.

The object of the present invention is to provide a simple and at the same time very compact device for wet granulation of liquid slag.

SUMMARY OF THE INVENTION

A device for wet granulation of liquid slag according to the invention comprises a granulating basin with an injection device for the granulating water, a decanting basin, separate from the granulating basin, in which the slag settles as granulate, as well as a device for introducing the granulate/water mixture from the granulating basin into the decanting basin. This device comprises at least one oblong distributor duct, which extends over the decanting basin and which has outlets for the granulate/water mixture distributed over the length of its underside. These outlets may, for example, comprise an outlet slot or several outlet openings arranged one behind the other. In the decanting basin a vertical, open at the bottom inflow shaft, into which the outlets for the granulate/water mixture discharge, is arranged under the at least one distributor duct. This inflow shaft can for example easily be formed by two screening walls attached to the distributor duct. The granulate/water mixture can be introduced into the decanting basin largely without turbulence through the distributor duct, its outlets and the inflow shaft. This ensures that the slag granulate also settles satisfactorily in relatively small decanting basins. The present invention consequently enables the creation of a compact device for wet granulation of liquid slag with extremely simple means.

The decanting basin advantageously comprises overflow devices for the granulating water at its upper edge. The "clarified" granulating water is removed from the decanting basin via these overflow devices during the granulation and, if necessary, returned to the injection device in the granulating basin. In a preferred embodiment the distributor duct is positioned lower than these overflow devices and is consequently below the water level in the decanting basin.

For withdrawal of the granulate from the decanting basin the latter advantageously comprises at least one funnel-shaped recess with an outlet connection piece and a shut-off valve for closing the outlet connection piece.

Utilization of space in the decanting basin is optimized by the fact that the inflow shaft and the at least one funnel-shaped recess have a common plane of symmetry. A particularly compact device can be achieved by a decanting basin having several funnel-shaped recesses one behind the other, the inflow shaft and the funnel-shaped recesses one behind the other having a common plane of symmetry.

The granulating basin is advantageously designed as an oblong basin with a bottom surface, two lateral faces and two end faces. The injection device for the granulating water is arranged at a first end face of this basin and the at least one distributor duct forms its discharge opening into the granulating basin at the opposite end of the basin.

In a preferred embodiment the injection device for the granulating water comprises a chamber, which surrounds the first end of the basin and has outlet nozzles for the granulating water. These outlet nozzles for the granulating water are preferably arranged in the two lateral faces as well as in the first end face of the basin.

BRIEF DESCRIPTION OF THE DRAWINGS

A preferred embodiment of the invention is described below on the basis of the accompanying drawings in which.

DESCRIPTION OF A PREFERRED EMBODIMENT

Figure 1:
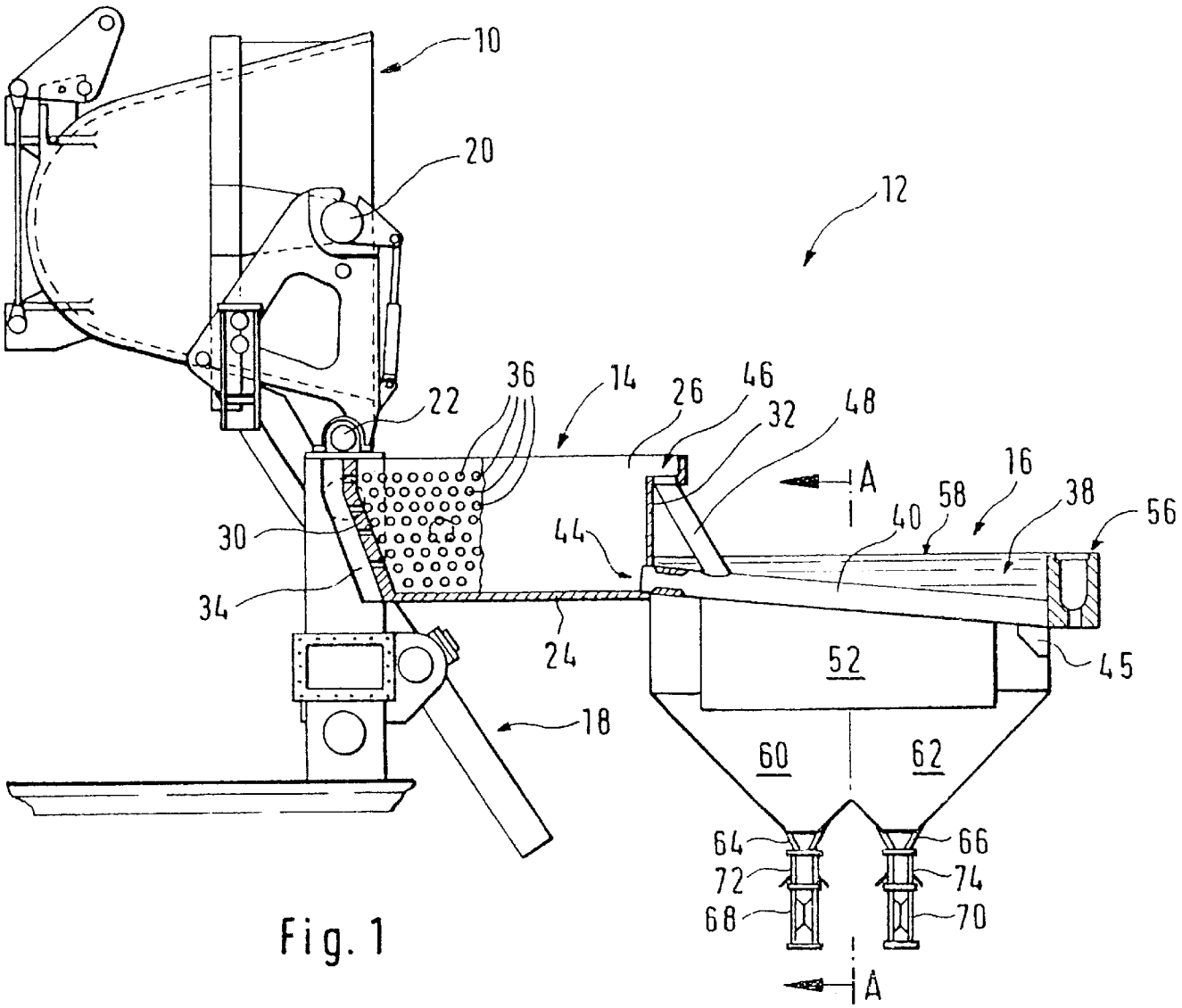
FIG. 1: is a longitudinal section through a device for wet granulation of liquid slag according to the invention with a slag ladle in the emptying position.
Figure 2:
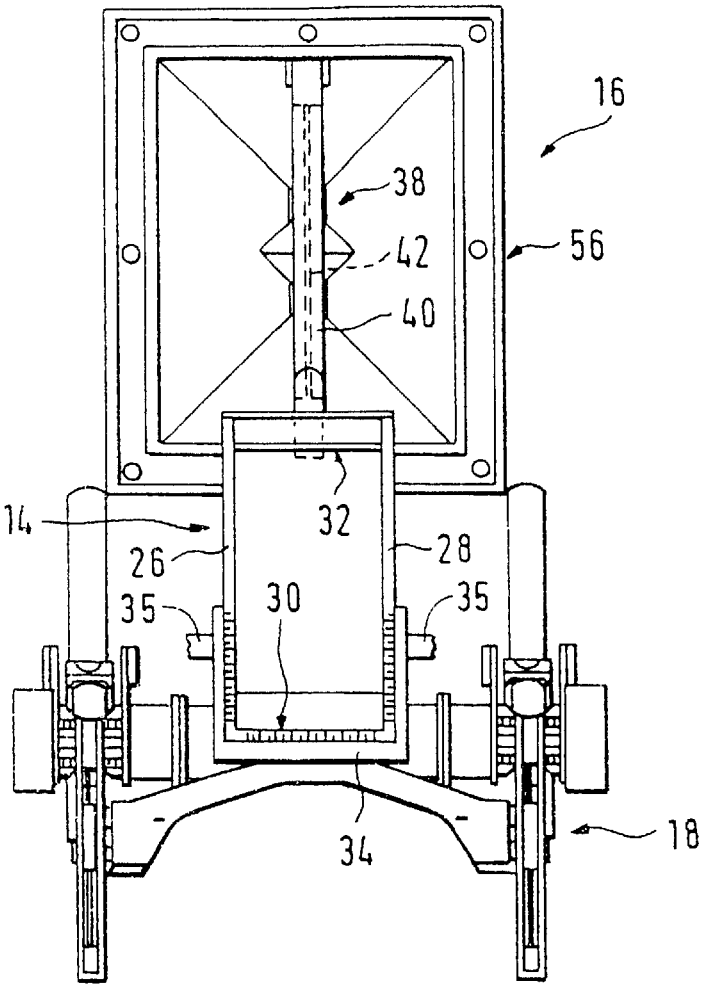
FIG. 2: is a plan view of the device in FIG. 1 without the slag ladle.

In FIG. 1 reference 10 designates a slag ladle with liquid slag, which is to be granulated in a granulating device 12 according to the invention. This granulating device 12 consists essentially of a granulating basin 14 and a decanting basin 16, which is attached directly to the granulating basin 14.

The granulating device 12 furthermore comprises a slewing device 18 for emptying the slag ladle 10 into the granulating basin 14. The slewing device 18 grips the slag ladle 10 at its bearing journals 20 and slews it about a slewing axis 22 into a discharge position above the rear end face of the granulating basin 14, such that the liquid slag can flow into the granulating basin 14. The angle of inclination of the ladle 10 is adapted such that the slag flow into the granulating basin 14 is as constant as possible.

The granulating basin 14 is formed by an oblong basin, which has a bottom surface 24, two lateral faces 26, 28, as well as a rear end face 30 and a front end face 32. The liquid slag flows from the slag ladle 10 into the rear end face of the granulating basin 14. Here, an injection device for the granulating water is installed in the basin. This injection device comprises a water chamber 34, which encloses the rear end face 30 and rear section of the two lateral faces 26 and 28. The granulating water is fed to the water chamber 34 via connection pieces 35. The granulating water flows from the water chamber 34 into the oblong basin of the granulating basin via a large number of outlet openings 36 in the rear end face 30 and the two lateral faces 26 and 28. An inflow rate in the order of about 10 m/s should be achieved at the outlet openings 36. About liquid slag.

In the granulating basin 14 the liquid slag is caught by the granulating water flow, whereby the slag granulates and solidifies. The more turbulent the water is in the granulating basin, the lower is the risk of explosion due to release of hydrogen and to the explosive overheating of water vapour.

The granulating basin 14 is connected to the decanting basin 16 via a device for introducing the granulate/water mixture into the decanting basin 16, which is generally designated 38 in the figures. This device 38 comprises at least one tubular distributor duct 40, which extends over the decanting basin 16 in the longitudinal direction of the latter. On its underside this distributor duct 40 has outlets 42 for the granulate/water mixture, which are distributed over the length of the decanting basin 16. These outlets 42 may for example comprise one or more outlet slots and/or several outlet openings arranged one behind the other. The outlets 42 should be arranged such that the granulate/water flow from the granulating basin through the distributor duct 40 is distributed as uniformly as possible over the full length of the decanting basin 16. It remains to be noted that the distributor duct 40 is laid with a gradient, the top end forming a discharge opening 44 for the granulate/water flow in the front end face 32 of the granulating basin 14 immediately above the bottom surface 24. The bottom end of the distributor duct 40 is closed and lies on a supporting base 45 on the decanting basin 16. As is apparent from FIG. 1, the granulating basin 14 comprises on its front end face 32 an overflow 46, which is also connected to the distributor duct 40 by means of an overflow pipe 48.

Figure 3:
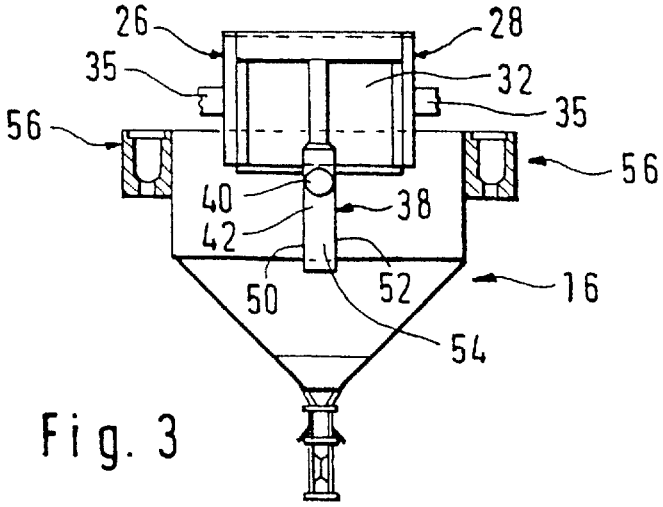
FIG. 3: is a cross-section along the line A—A through the device in FIG. 1.

In FIG. 3 it can be seen that screen walls 50, 52, which extend into the decanting basin 16 to a point well below the outlets 42 in the distributor duct 40, are mounted on both sides of the distributor duct 40. These screen walls 50, 52 form under the distributor duct 40 a vertical inflow shaft 54 open at the bottom, into which the outlets 42 for the granulate/water mixture discharge. The granulate/water mixture can be fed largely without turbulence into the decanting basin 16 through the distributor duct 40, its outlets 42 and the inflow shaft 54. This ensures that the slag granulate settles satisfactorily in the relatively small decanting basin 16.

The decanting basin 16 is provided at its upper edge with an overflow duct 56 for the granulating water. The "clarified" granulating water is withdrawn from the decanting basin 16 via this overflow duct 56 during the granulation. It should be noted that the distributor duct 40 is positioned lower and consequently below the water level 58 in the decanting basin 16. The device according to the invention for introduction of the granulate/water mixture into the decanting basin 16, as described above, ensures that most of the granulate particles settle in the decanting basin 16 before the granulating water flows into the peripheral overflow duct 56. From the overflow duct, the "clarified" granulating water can be fed back into the injection device of the granulating basin 14.

For removal of the granulate from the granulating basin 16 the latter has in its bottom surface two funnel-shaped recesses 60, 62, each with an outlet connection piece 64, 66 and a shut-off valve 68, 70 for closing the outlet connection piece. The granulate accumulates in these recesses 60, 62 and can be removed by opening the shut-off valves 68, 70. The shut-off valves 68, 70 are preferably compression valves, i.e. valves with a diaphragm, which encloses a through duct in the valve and constricts this through duct when a pressure medium is applied. Upstream of each shut-off valve 68, 70 is located a filter connection 72, 74, via which the decanting basin 16 is dewatered before removal of the granulate.

The simplicity and compactness of the granulating device 12 described make it particularly suitable for use in an electric steel plant. It is of advantage that the electroslag has a relatively high specific gravity and consequently settles well in the decanting basin.

We claim:

1. A device for wet granulation of liquid slag comprising:

a granulating basin with an injection device for granulating water, wherein a granulate/water mixture is formed in said granulating basin;

a decanting basin separated from said granulating basin for settling the granulate;

an oblong distributor duct extending from said granulating basin over said decanting basin for introducing the granulate/water mixture from the granulating basin into the decanting basin, said distributor duct having an underside with outlet means for the discharge of the granulate/water mixture along said underside; and an oblong vertical inflow shaft with an open bottom formed in said decanting basin under said oblong distributor duct, so that said outlet means of said oblong distributor duct discharge the granulate/water mixture into said vertical inflow shaft.

2. The device according to claim 1, wherein said decanting basin has an overflow means for the granulating water.

3. The device according to claim 2, wherein said distributor duct is arranged at a lower level than said overflow means.

4. The device according to claim 1, wherein said inflow shaft is formed by two screen walls secured to said distributor duct.

5. Device according to claim 1 wherein said decanting basin has at least one funnel-shaped recess with an outlet connection piece for the granulate and a shut-off valve to close off said outlet connection piece.

6. The device according to claim 5, wherein said outlet connection piece includes a dewatering means for dewatering the granulate upstream of said shut-off valve.

7. The device according to claim 5, wherein said decanting basin has at least two funnel-shaped recesses one behind the other, said inflow shaft and said at least two funnel-shaped recesses having a common plane of symmetry.

8. The device according to claim 1 wherein said granulating basin is an oblong basin with a bottom surface, two lateral faces and two end faces, said injection device for the granulating water being arranged at a first end thereof and said distributor duct forming a discharge opening to granulating basin at the opposite end thereof.

9. The device according to claim 8, wherein said injection device for the granulating water has a multiplicity of outlet nozzles in said two lateral faces and in said first end face of said basin.

10. The device according to claim 1, wherein said outlet means in said oblong distributor duct comprises an outlet slot.

11. The device according to claim 1, wherein said outlets means in said oblong distributor duct comprises several aligned outlet openings.

* * * * *

UNITED STATES PATENT AND TRADEMARK OFFICE

CERTIFICATE OF CORRECTION

PATENT NO. : 6,516,632 B1
DATED : February 11, 2003
INVENTOR(S) : Ulveling et al.

It is certified that error appears in the above-identified patent and that said Letters Patent is hereby corrected as shown below:

Column 4,
Line 54, insert -- said -- after "to".

Signed and Sealed this

Tenth Day of June, 2003

JAMES E. ROGAN
*Director of the United States Patent and Trademark Office*